US009079320B2

(12) United States Patent
Onion

(10) Patent No.: US 9,079,320 B2
(45) Date of Patent: Jul. 14, 2015

(54) FOLDING KNIFE WITH DISENGAGEABLE ASSISTED-OPENING MECHANISM

(75) Inventor: Kenneth J. Onion, Kaneohe, HI (US)

(73) Assignee: KAI U.S.A., LTD., Tualatin, OR (US)

( * ) Notice: Subject to any disclaimer, the term of this patent is extended or adjusted under 35 U.S.C. 154(b) by 1100 days.

(21) Appl. No.: 11/422,032

(22) Filed: Jun. 2, 2006

(65) Prior Publication Data

US 2007/0068002 A1 Mar. 29, 2007

Related U.S. Application Data

(60) Provisional application No. 60/687,009, filed on Jun. 2, 2005.

(51) Int. Cl.
*B26B 1/04* (2006.01)

(52) U.S. Cl.
CPC ..... *B26B 1/044* (2013.01)

(58) Field of Classification Search
USPC ..... 30/155, 158–160, 337–338, 162
See application file for complete search history.

(56) References Cited

U.S. PATENT DOCUMENTS

| | | | | | |
|---|---|---|---|---|---|
| 1,701,771 | A * | 2/1929 | Di Stefano | 30/162 |
| 2,705,832 | A * | 4/1955 | Mirando | 30/159 |
| 5,095,624 | A * | 3/1992 | Ennis | 30/161 |
| 5,325,588 | A * | 7/1994 | Rogers | 30/161 |
| 5,815,927 | A | 10/1998 | Collins | |
| 5,819,414 | A | 10/1998 | Marifone | |
| 6,079,106 | A * | 6/2000 | Vallotton | 30/161 |
| 6,145,202 | A | 11/2000 | Onion | |
| 6,308,420 | B1 | 10/2001 | Moser | |
| 6,338,431 | B1 | 1/2002 | Onion | |
| 6,397,477 | B1 * | 6/2002 | Collins | 30/161 |
| 6,643,936 | B2 * | 11/2003 | Carlson et al. | 30/162 |
| 6,834,432 | B1 | 12/2004 | Taylor, Jr. | |
| 6,941,661 | B2 | 9/2005 | Frazer | |
| 6,949,109 | B2 * | 9/2005 | Iske et al. | 606/167 |
| 6,959,494 | B2 | 11/2005 | Taylor | |
| 7,054,441 | B2 | 5/2006 | Pletikosa | |
| 7,107,686 | B2 | 9/2006 | Linn | |
| 7,124,509 | B1 * | 10/2006 | Hawk | 30/160 |
| 7,302,760 | B2 * | 12/2007 | Lake | 30/161 |
| 2002/0104220 | A1 * | 8/2002 | Marfione | 30/160 |
| 2003/0070299 | A1 | 4/2003 | Frazer et al. | |
| 2003/0226260 | A1 * | 12/2003 | Sullivan | 30/160 |

OTHER PUBLICATIONS

"670 Apparition Optimizer Instructions", Benchmade Knife Co, Inc. www.benchmade.com, 1 page.

* cited by examiner

*Primary Examiner* — Phong Nguyen
(74) *Attorney, Agent, or Firm* — Seed IP Law Group PLLC

(57) ABSTRACT

A knife includes a handle and a blade coupled to the handle so as to be movable between an open position in which the blade extends from the handle, and a closed position, in which the blade is received within the handle. An assisted opening mechanism is operatively coupled between the blade and the handle, and is configured to provide an opening-assist to the blade. An engagement mechanism is also provided, which is switchable between an engaged condition, in which the assisted opening mechanism is enabled, and a disengaged condition, in which the assisted opening mechanism is disabled such that it does not provide an opening assist to the blade.

17 Claims, 9 Drawing Sheets

FOLDING KNIFE WITH DISENGAGEABLE ASSISTED-OPENING MECHANISM

CROSS-REFERENCE TO RELATED APPLICATION

This application claims the benefit of U.S. Provisional Patent Application No. 60/687,009 filed Jun. 2, 2005, where this provisional application is incorporated herein by reference in its entirety.

BACKGROUND OF THE INVENTION

1. Field of the Invention

Disclosed embodiments of the invention generally relate to folding knives, and more particularly, to knives employing assisted-opening mechanisms.

2. Description of the Related Art

A folding knife typicality includes a blade and handle pivotably coupled to allow the blade to rotate, relative to the handle, between an open position, in which the blade extends from the handle, and a closed position, in which the blade is received in a corresponding recess in the handle. Such knives have enjoyed wide use for more than a hundred years due to their compactness, ease of handling, safety, and versatility.

The recent development of various assisted-opening mechanisms for folding knives has been extremely popular, perhaps in part because of the added utility such mechanisms provide, while maintaining a level of safety that is not found in knives such as automatic, or "switch-blade" knives.

An assisted-opening mechanism typically includes a bias member configured to move the blade toward the open position when the blade is manually rotated from the closed position to beyond an equilibrium or threshold point. However, while the blade is in the closed position, the biasing member is generally configured to apply a reverse bias to the blade, tending to hold the blade in the closed position.

Examples of knives equipped with assisted-opening mechanisms may be found in U.S. Pat. Nos. 6,145,202; 6,338,431; U.S. patent application Ser. No. 10/774,310; and U.S. patent application Ser. No. 10/680,751, all of which are incorporated herein by reference, in their entirety.

BRIEF SUMMARY OF THE INVENTION

According to an embodiment of the invention, a knife is provided, including a handle and a blade coupled to the handle so as to be movable between an open position in which the blade extends from the handle, and a closed position, in which the blade is received within the handle. An assisted opening mechanism is operatively coupled between the blade and the handle, and is configured to provide an opening-assist to the blade. An engagement mechanism is also provided, which is switchable between an engaged condition, in which the assisted opening mechanism is enabled, and a disengaged condition, in which the assisted opening mechanism is disabled such that it does not provide an opening assist to the blade.

DETAILED DESCRIPTION OF THE INVENTION

Figure 1:
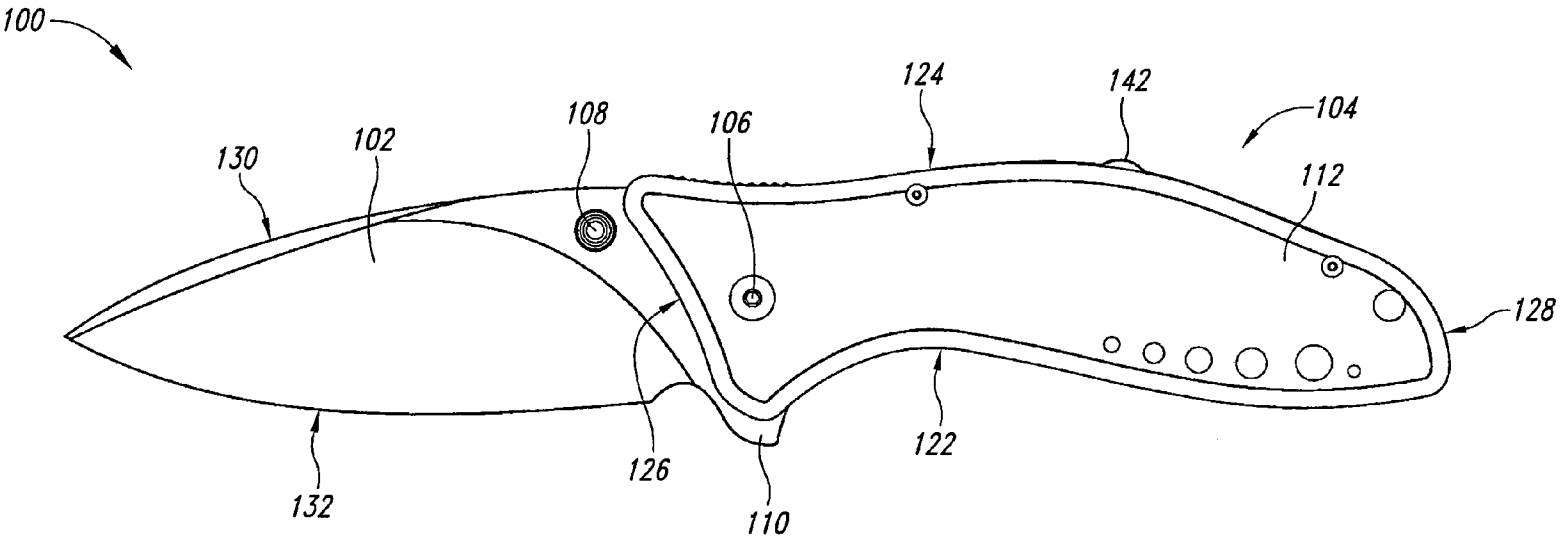
FIG. 1 is a side elevation view of a folding knife according to an embodiment of the invention.

For the purpose of the present disclosure, a number of terms may be used in reference to folding knives in general or to the embodiments disclosed herein. Reference numerals are provided in FIG. 1 to help define the terms, but are not included in the remaining figures: the front of the handle 122 includes an opening into which the blade is received when the blade is in the closed position, and is the lower part of the knife, as oriented in the figures; the back of the handle 124 lies opposite the front of the handle; the top of the handle or top end of the handle 126 is the end closest to the pivot point around which the blade pivots between the open and closed positions; the bottom end or bottom of the handle 128 is opposite the top end; the first side of the handle is the side closest to the viewer and the second side is the side furthest away from the viewer; the back of the blade 130 is the edge of the blade that is opposite the sharpened edge 132, such that, when the blade is in the open position, the back of the handle and the back of the blade correspond to each other as seen in the figures. It will be understood that these terms are provided to assist in comprehension of the disclosure, and do not limit actual embodiments of the invention, unless specifically indicated. Other terms, such as above, below, right, left, etc., may be used to describe features of the embodiments, and are to be understood as referring to the features as they appear in the figures, without limiting those features as they may be employed in actual embodiments.

Many commonly known features of folding knives are omitted in the figures and descriptions of embodiments of the invention. For example, fasteners, such as machine screws, bolts, rivets, pins, etc., are well known in the art, and need not be discussed in detail here. Other features are described to provide context for the embodiments described, but are not essential to the invention or particular embodiments. For example, thumb studs are pictured in each of the embodiments, but are not an essential aspect of the invention. Likewise, other features found in some or all of the disclosed embodiments are not to be construed as being essential to a claimed embodiment unless so indicated.

Figure 2:
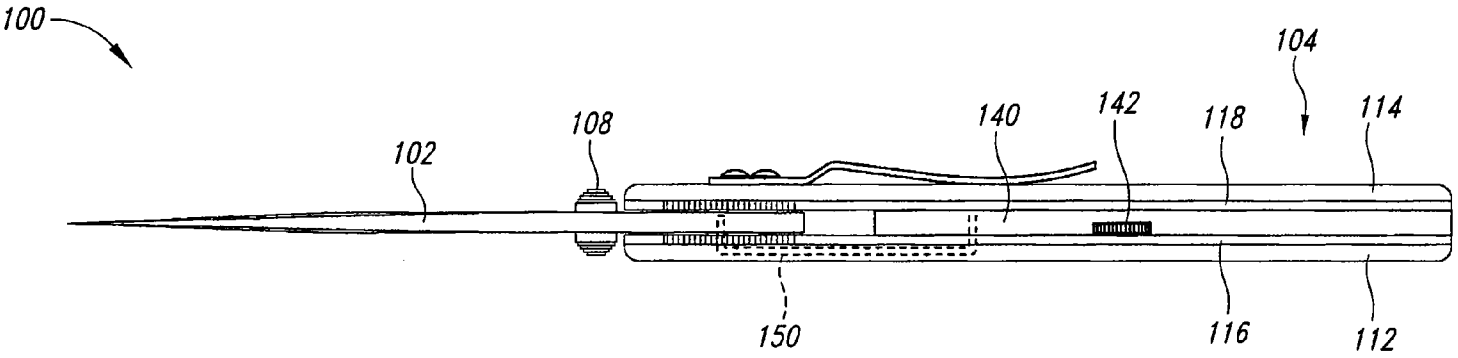
FIG. 2 shows the knife of FIG. 1 in a top plan view.

FIG. 1 shows a front elevational view of a folding knife 100 according to an embodiment of the invention, while FIG. 2 shows a top plan view of the knife 100. The knife 100 includes a blade 102 pivotably coupled to a handle 104 at pivot point 106 such that the blade 102 is rotatable between an open position, as shown in FIG. 1, and a closed position, in which the blade is received in a space provided in the handle 104, as shown, for example, in FIG. 4.

The blade includes a thumb stud 108 and a flipper 110. The flipper 110 is a portion of a tang of the blade 102 that is enlarged such that it extends from the back of the handle when the blade 102 is in the closed position, and a user may use either the thumb stud 108 or the flipper 110 to move the blade toward the open position. The handle 104 includes first and second scales 112, 114 and first and second liners 116, 118. A backspacer 140 is positioned between the first and second liners 116, 118 and serves to space the liners apart such that an opening is maintained therebetween to receive the blade 102 while in the closed position.

Figure 3:
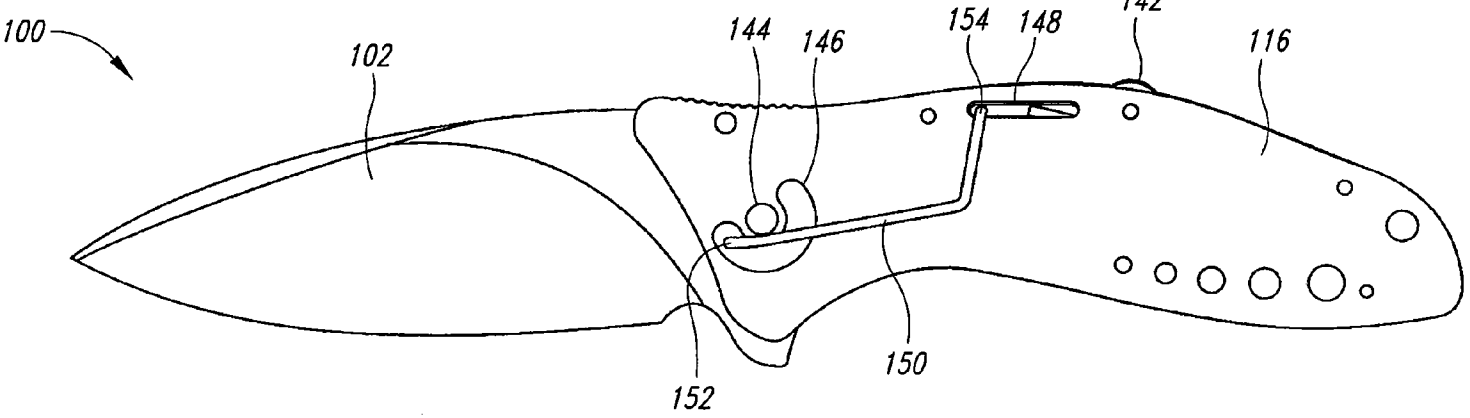
FIG. 3 shows the knife of FIG. 1 with a handle scale removed.

FIG. 3 shows the knife 100 with the first scale 112 removed. As seen in FIG. 3, an assist spring 150 is positioned between the first scale 112 and the first liner 116. A cavity (not shown) is provided in the first scale 112 to accommodate the spring 150 while allowing free movement thereof. The assist spring 150 includes first and second ends 152, 154, the first end 152 being configured to engage an aperture formed in the blade 102, and the second end 154 configured to traverse a slot 148 formed in the first liner 116 and to engage a slot 162 formed in the backspacer 140. The plan view of FIG. 2 shows the assist spring 150 in hidden lines to show the first and second ends 152, 154 of the spring 150 where they extend toward the second side of the knife 100 to engage the blade 102 and backspacer 140. The first liner 116 further includes an arcuate slot 146 within which the first end 122 of the spring 150 travels as the blade 102 is rotated between the open position and the closed position. An assisted-opening mechanism similar to that described herein is described in detail in many of the incorporated patents, including U.S. Pat. No. 6,338,431.

Figure 4:
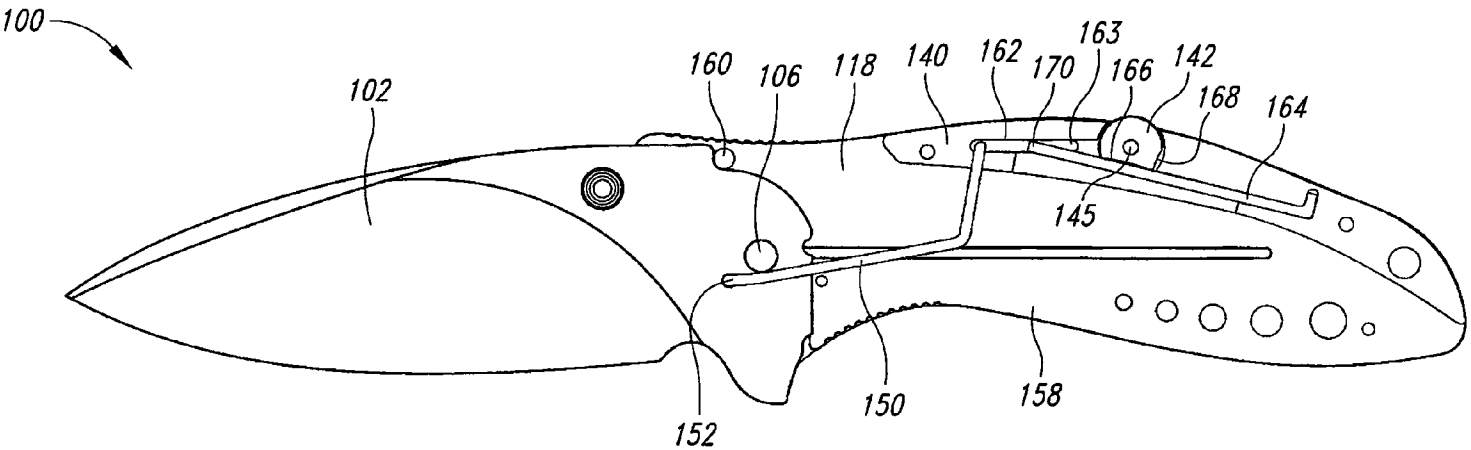
FIGS. 4-7 show the knife of FIG. 1 in various stages of operation, with a scale and liner removed.
Figure 5:
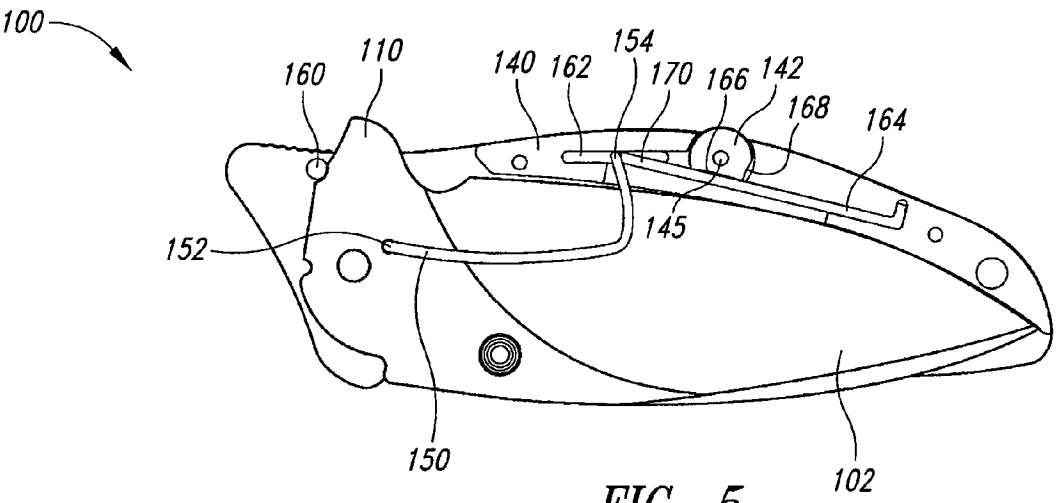

Referring now to FIG. 4, the knife 100 is shown with the first liner 116 removed to show the underlying structure. A stop-pin 160 is positioned between the first and second liners 116, 118 and provides a surface against which the tang of the blade 102 bears when the blade 102 is in the open position, as shown in FIG. 4. The tang also bears against the stop pin 160 when the blade is in the closed position, as shown in FIG. 5. A liner lock 158 is configured to lock the blade in the open position in a known manner.

Backspacer 140 is positioned between the first and second liners 110, 112. The backspacer 140 includes a slot 162 configured to receive the second end 124 of the assist spring 150. The slot 162 includes a slot extension 163 extending rearward, i.e., generally toward the bottom of the knife 100. An engagement spring 164 is positioned in a recess formed in a first face of the backspacer 140 such that an end 170 thereof normally extends into the slot 162 of the backspacer 140, blocking travel of the second end 154 of the assist spring 150 into the slot extension 163.

An engagement wheel 142 is rotatably positioned in a recess in the backspacer 140 such that a knurled portion thereof extends out the back of the handle 104 so as to be accessible to an operator for rotation between an engaged position and a disengaged position. The engagement wheel 142 also includes first and second cam surfaces 166, 168. The first cam surface 166 lies a first distance from a pivot center 145 of the wheel 142 such that when the wheel is positioned in the engaged position and the first cam surface lies against the engagement spring, the end 170 of the engagement spring 164 extends into the slot 162 in the backspacer 140, as described above. FIGS. 4 and 5 show the engagement wheel 142 in the engaged position.

Figure 6:
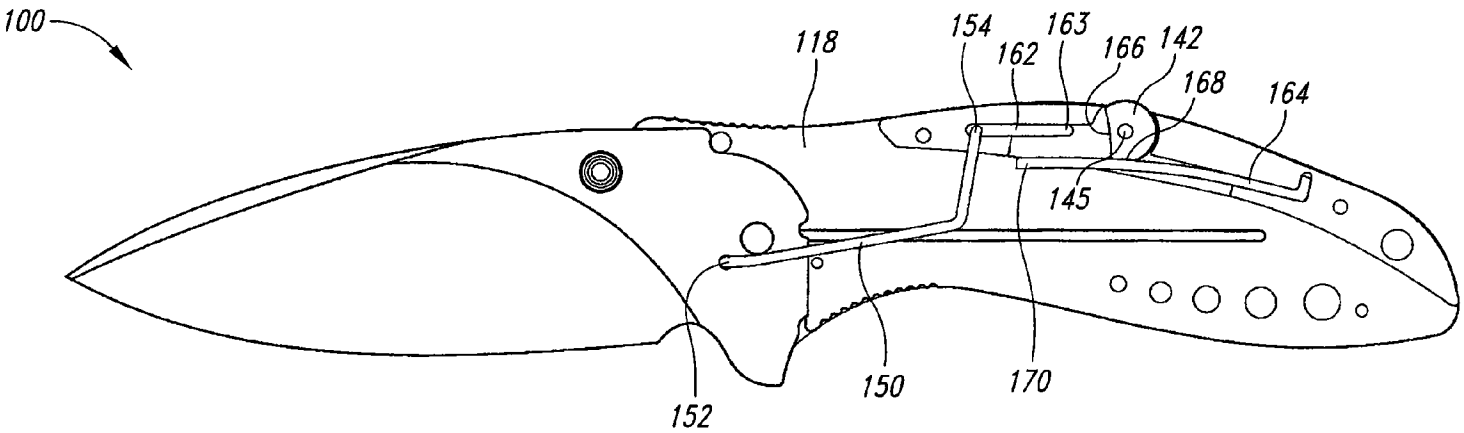
Figure 7:
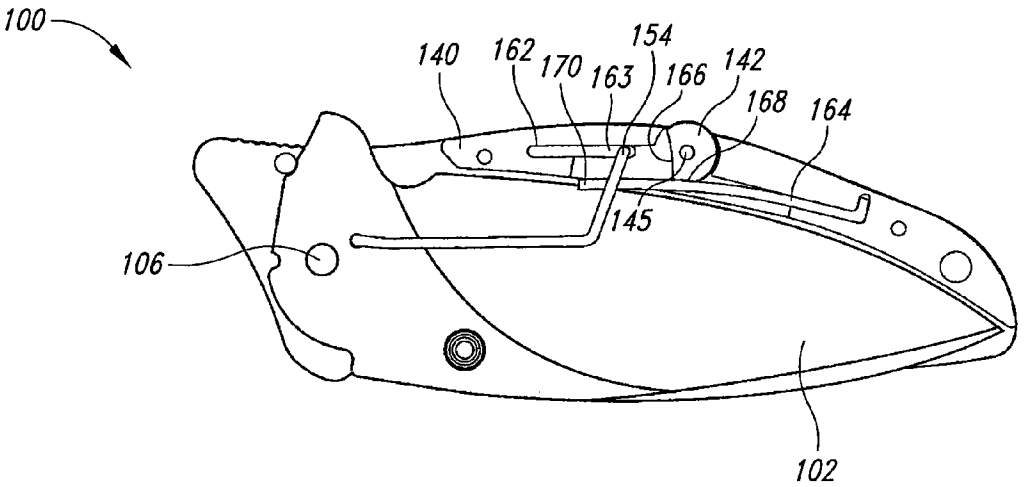

The second cam surface 168 of the engagement wheel 142 lies a second distance, greater than the first distance, away from the pivot center 145 of the wheel, such that when the wheel is in the disengaged positioned, in which the second cam surface lies against the engagement spring 164, the end of the engagement spring 164 is flexed away from the slot 162 of the backspacer 140 such that the second end 154 of the assist spring 150 is free to travel into the slot extension 163. FIGS. 6 and 7 show the engagement wheel 142 in the disengaged position.

While the engagement wheel 140 is positioned in the engaged position, as shown in FIGS. 4 and 5, the opening assist mechanism of the knife 100 is enabled, and movement of the second end of the assist spring 150 is limited to the forward portion of the slot 162 of the backspacer 140. Accordingly, when the blade 102 is rotated from the open position, as shown in FIG. 4 to the closed position, as shown in FIG. 5, the second end 154 of the assist spring 150 travels in the slot 162 until it bears against the end of the engagement spring 164. As the blade 102 continues to rotate, the assist spring 150 flexes, storing energy. In the fully closed position, as shown in FIG. 5, the assist spring 150 biases the blade 102 toward the closed position. When the blade 102 is moved a short distance away from the closed position, the assist spring 150 crosses "overcenter" and begins to bias the blade 102 toward the open position. The assist spring 150 then moves the blade 102 rapidly toward the open position, thereby "assisting" in opening the blade. An opening assist mechanism of this kind is sometimes referred to as a torsion bar mechanism.

To disengage the opening assist mechanism of the knife 100, an operator places a finger or thumb against the engagement wheel 142 and rolls the wheel clockwise, as viewed in the figures, to place the second cam surface 168 against the engagement spring 164, as shown in FIGS. 6 and 7. This causes the engagement spring 164 to be held away from the slot 162, exposing the slot extension 163.

While the engagement wheel 140 is positioned in the disengaged position, as shown in FIGS. 6 and 7, the opening assist mechanism of the knife 100 is disabled, and the second end of the assist spring 150 is free to travel the length of the slot 162, including the slot extension 163. Accordingly, when the blade 102 is rotated from the open position, as shown in FIG. 6 to the closed position, as shown in FIG. 7, the second end 154 of the assist spring 150 travels unimpeded in the slot 162. In the fully closed position, the assist spring 150 is still completely relaxed, and does not apply any bias to the blade 102. In this configuration, the assist spring does not provide an opening assist; instead, the blade must be moved manually from the closed position to the open position.

A disengageable mechanism, such as that described above, can be advantageous for several reasons. Many individuals are unaccustomed to using an assisted opening knife, and are uncomfortable with the operation. The disengability of the mechanism allows such individuals to operate the knife manually, while also allowing them to switch to an assisted mode when they become more proficient in its use. Some jurisdictions may restrict the use of opening assisted knives. Thus, while in such a jurisdiction, a user can disengage the mechanism in order to be in compliance with such local restrictions. Additionally, if a knife is to be stored for a long period, the mechanism can be disengaged so that the assist spring is not held in a tensioned condition, thereby preserving the strength of the spring.

FIGS. 8-12 Illustrate a folding knife 200 according to another embodiment of the invention. The opening assist mechanism of the knife 200 is a torsion bar mechanism like that described above. Accordingly, the knife 200 shares many structural similarities with the knife 100 of FIGS. 1-7. Identical reference numbers indicate structures of such similarity as to require little or no additional description.

Figure 8:
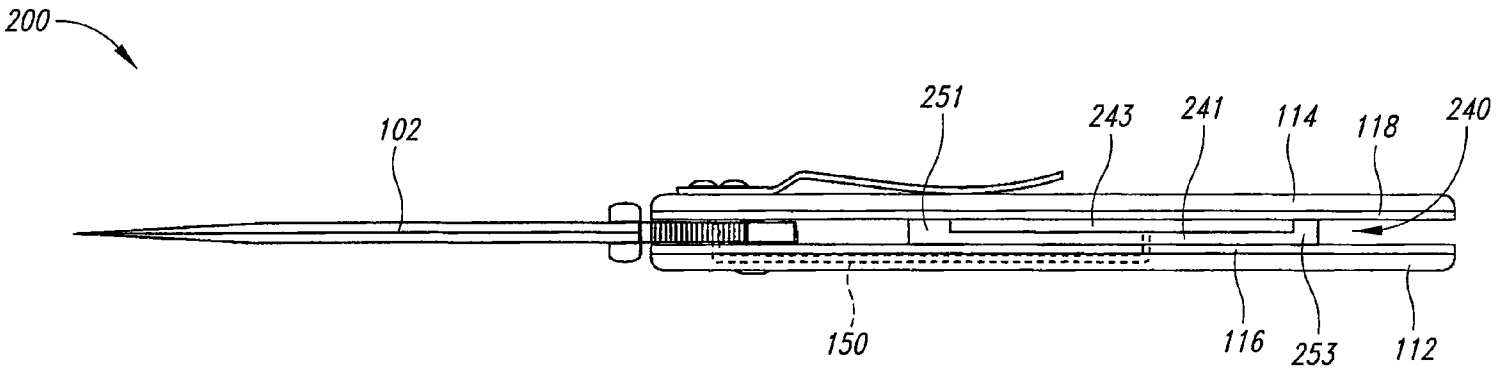
FIG. 8 shows a knife according to another embodiment, in a top plan view.

FIG. 8 shows the knife 200 in plan view. In this figure it can be seen that the backspacer 240 is split longitudinally into first and second segments 241, 243. First segment 241 is rotatable between an engaged position, as shown in FIGS. 9 and 10, and a disengaged position, as shown in FIGS. 11 and 12.

Apertures in the backspacer 240 provide passage for three fasteners such as, for example, machine screws. The first segment 241 of the backspacer includes a first aperture 245 around which it is configured to rotate between an engaged position and a disengaged position. Second and third apertures 247, 249 are elongated to permit limited rotation of the segment 241, while corresponding apertures in the second segment 243 are not elongated, preventing the second segment from rotating. The slot 262 extends through both segments 241, 243 of the backspacer 240. In the second segment, the slot 262 extends with a consistent width its entire length, including the length of the slot extension 263. This portion of the slot 262 is most clearly visible in FIGS. 11 and 12. In the first segment 241, the slot 262 includes a stepped portion 255 separating the slot extension 263 from the remainder of the slot 262.

Figure 9:
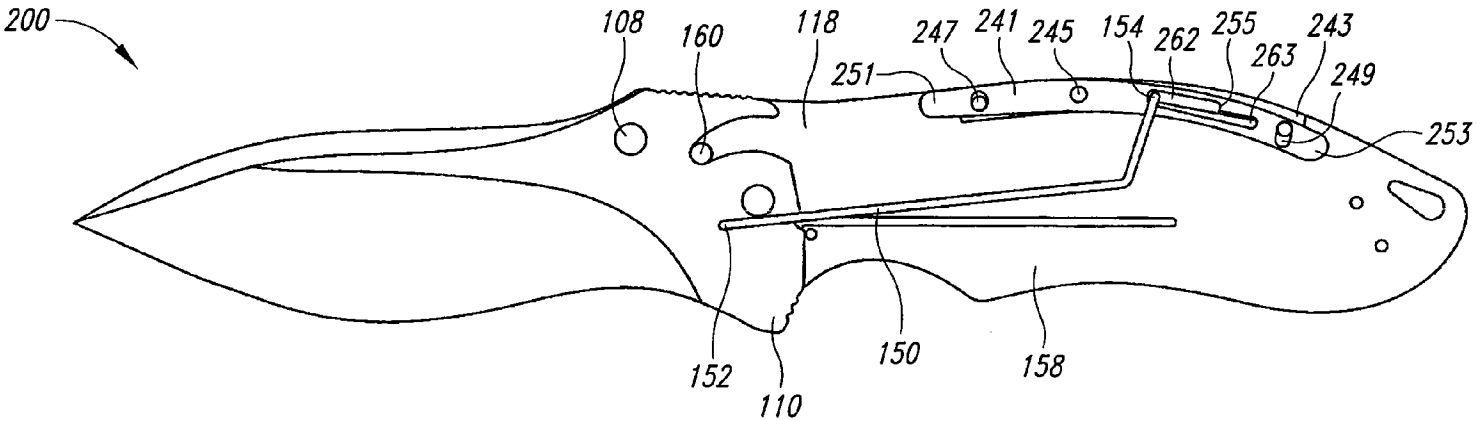
FIG. 9-12 show the knife of FIG. 8 in various stages of operation, with a scale and liner removed.
Figure 10:
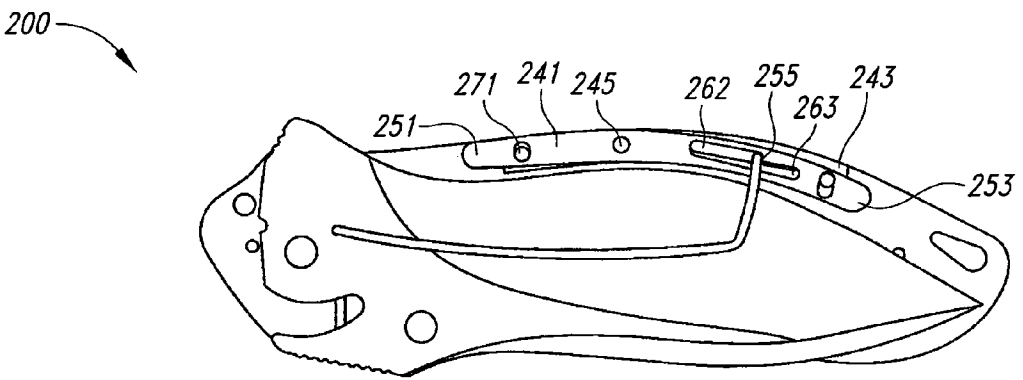

While the first segment 241 is positioned in the engaged position, the opening assist mechanism of the knife 100 is engaged, as shown in FIGS. 9 and 10. A forward end 251 of the segment 241 is substantially flush with a back edge of the handle 104, and a rearward end 253 of the first segment 241 is depressed into the handle, as shown in FIGS. 9 and 10. In this position, the length of the slot 262 is limited to a distance between the stepped portion and the forward end of the slot 262. Accordingly, when the blade 102 is rotated from the open position, as shown in FIG. 9 to the closed position, as shown in FIG. 10, the second end 154 of the assist spring 150 travels in the slot 262 until it bears against the stepped portion 255 of the slot 262 in the first segment 241. Operation of the knife 200 with the first segment 241 positioned as shown in FIGS. 9 and 10 is substantially identical to the operation of the knife 100 as described with reference to FIGS. 4 and 5.

Figure 11:
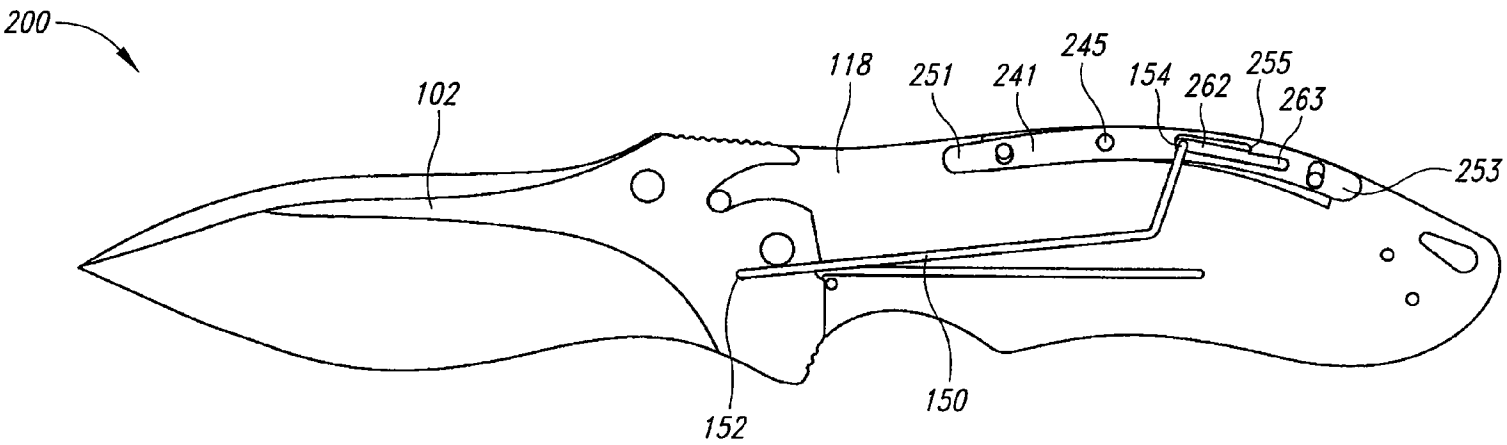
Figure 12:
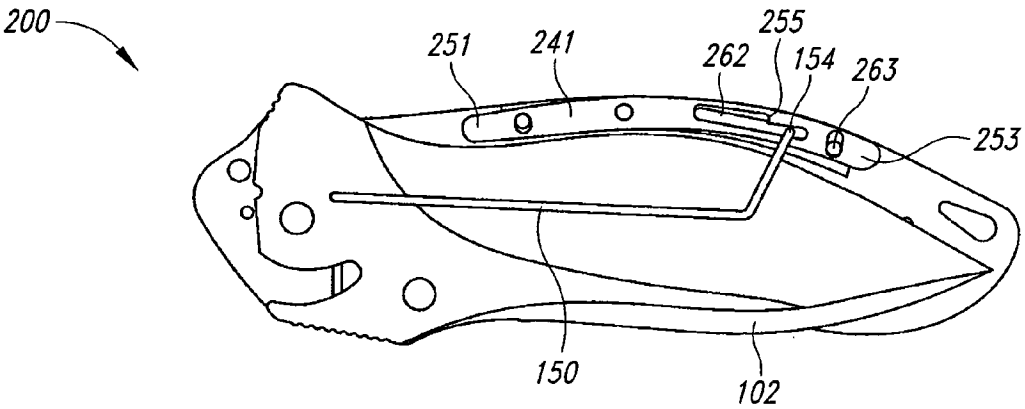

To disengage the assist mechanism of the knife 200, the operator merely presses inward at the forward end 251 of the first segment 241, causing the segment to pivot on the fastener in the first aperture 245 until the rearward end 253 of the second segment 241 is substantially flush with the back edge of the handle, and the forward end 251 is recessed into the handle, as shown in FIGS. 11 and 12. In this position, it can be seen that the stepped portion of the slot 262 no longer obstructs passage of the spring 150, which is therefore free to travel the entire length of the slot 262. In this configuration, the knife 200 operates in a manner that is substantially identical to the operation of the knife 100 as described with reference to FIGS. 6 and 7.

The first segment 241 is described and shown as lying either flush with, or recessed into the handle, according to a position thereof. This provides a smooth, substantially featureless surface along the back of the handle. However, the first segment may also include portions that extend from the back of the handle for easier access. For example, the forward end 251 and/or the rearward end 253 may include a knob or other feature extending out of the back of the handle.

Figure 13:
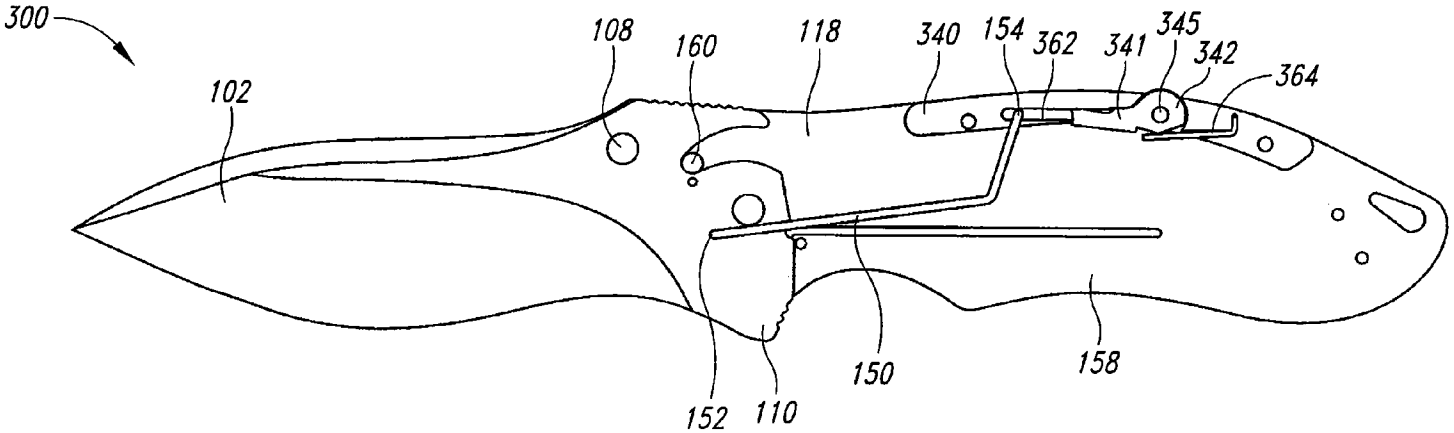
FIGS. 13 and 14 depict a knife according to a further embodiment, with a scale and liner removed to show an engagement mechanism respectively enabled and disabled.
Figure 14:
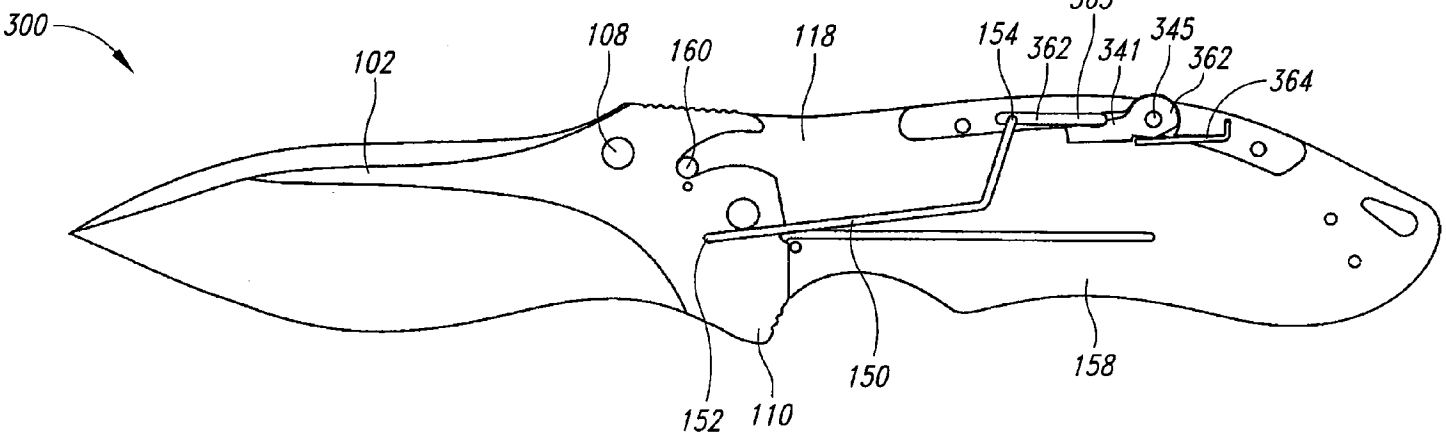

FIGS. 13 and 14 show a knife 300 according to one embodiment of the invention. A backspacer 340 is provided, with a pawl 341 and tensioner spring 364 recessed into the backspacer 340. The pawl 341 is configured to rotate on a pivot 345 between an engaged position, as shown in FIG. 13, and a disengaged position, as shown in FIG. 14. The pawl 341 includes a thumbwheel 342 that extends through a back surface of the backspacer 340 such that, when the knife 300 is fully assembled, the thumbwheel 342 is accessible to a user at the back of the handle. The tensioner spring 364 is provided to hold the pawl 341 in a position selected by the user.

While in the engaged position, the pawl 341 extends across the slot extension 363, effectively shortening the length of the slot 362. Operation of the knife 300 with the pawl 341 positioned as shown in FIG. 13 is substantially identical to the operation of the knife 100 as described with reference to FIGS. 4 and 5.

To disengage the opening assist mechanism, a user rotates the pawl 341 counter-clockwise, as viewed in the figures. This moves the pawl out of the slot 362, as shown in FIG. 14, and leaves the entire length of the slot 363 unobstructed, and the opening assist mechanism disengaged. In this configuration, the knife 300 operates in a manner that is substantially identical to the operation of the knife 100 as described with reference to FIGS. 6 and 7.

Figure 15:
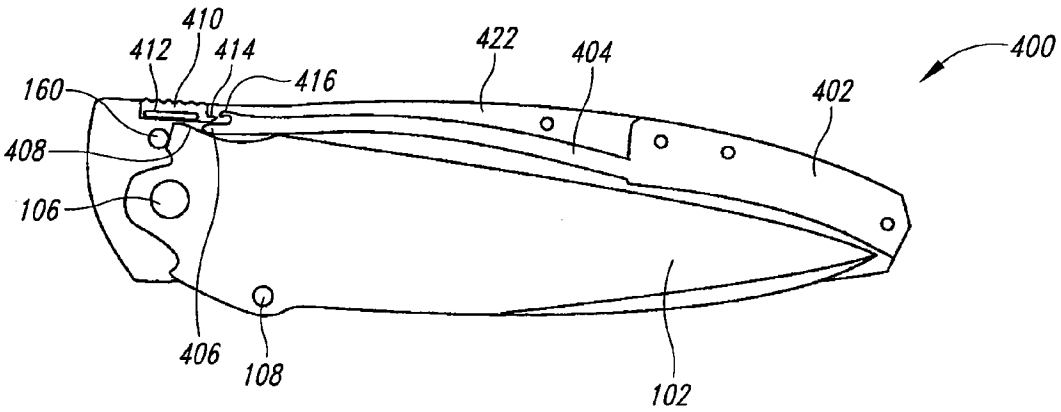
FIG. 15 shows a knife according to an additional embodiment, with a scale and liner removed.

Referring now to FIGS. 15-20, a folding knife 400 is illustrated according to another embodiment of the invention. Knife 400 includes a backspacer 402 and a leaf spring 404. The leaf spring 404 may be integral with the backspacer 402, as shown in the figures, or it may be a separate component coupled to the knife 400. In the embodiment shown, the leaf spring 404 lies substantially in the plane of rotation of the blade 102. This is in contrast to the previously disclosed embodiments, in which the opening assist mechanism lies to one side of the blade. While in a closed position, as shown in FIG. 15, an end 406 of the leaf spring 404 bears against a first surface 408 of the tang of the blade 102.

The surface 408 may be configured such that rotation of the blade 102 away from the closed position initially causes additional deflection of the leaf spring 404. In this way, the leaf spring 404 can be made to apply a closing bias to the blade while the blade is in the closed position. Alternatively, the first surface 408 of the tang of the blade can be configured such that there is no appreciable deflection of the leaf spring 404 during the initial rotation of the blade away from the closed position. Nevertheless, depending on the tension of the leaf spring 404, the biasing force of the leaf spring against the tang of the blade 102 may be sufficient to prevent movement of the blade away from the closed position simply due to friction. In any event, when the blade is opened beyond a threshold point, as shown in FIG. 17, the end 406 of the leaf spring 404 crosses a shoulder 424 of the tang, beyond which the leaf spring 404 applies force against a second surface 420 of the tang of the blade, driving the blade toward the open position, as shown in FIG. 18.

Figure 16:
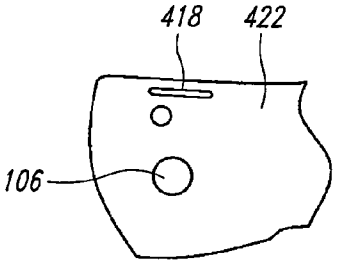
FIG. 16 shows a detail of the knife of FIG. 15.

Referring again to FIG. 15, the knife 400 is provided with an engagement latch 410 sized to fit between liners 422 of the knife 400. Tabs 412 extend from sides of the engagement latch 410 to engage slots 418 formed in the liners 422. FIG. 16 shows a detail of one of the liners 422 in which the slot 418 is visible. It will be understood that the knife 400 will include two liners 422, each having a slot 418, between which the latch 410 is positioned such that tabs 412 on either side of the latch 410 are received in respective slots 418. Alternatively, the slots 418 may be formed on inner surfaces of handle segments that are configured to be assembled without liners to form the handle of the knife 400.

The slots 418 are longer than the tabs 412 of the latch 410, thereby permitting the latch 410 to slide longitudinally between an engage position and a disengaged position. The latch 410 includes an engagement tooth 414 configured to be received within a notch 416 formed in the end 406 of the leaf spring 404. An upper surface of the latch 410 may be knurled as shown for easier manipulation.

Figure 17:
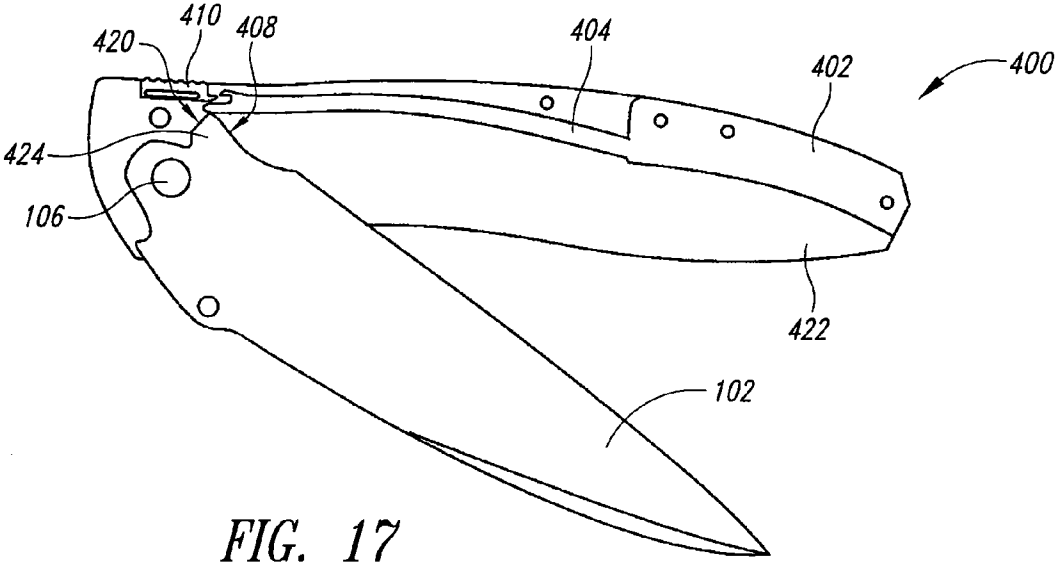
FIGS. 17-20 show the knife of FIG. 15 in various stages of operation.
Figure 18:
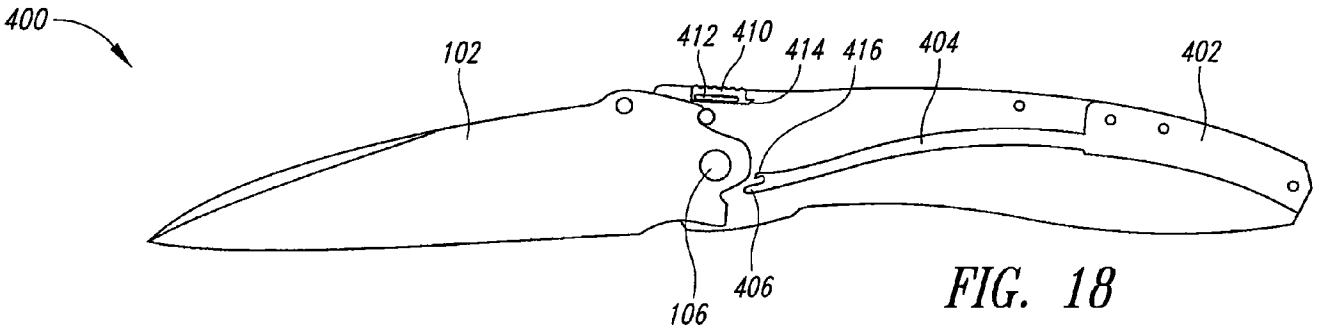
Figure 19:
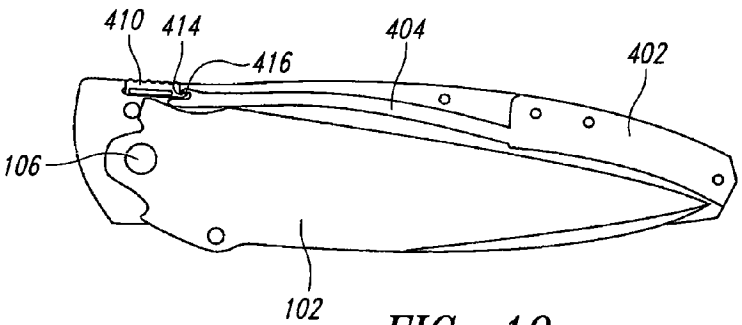
Figure 20:
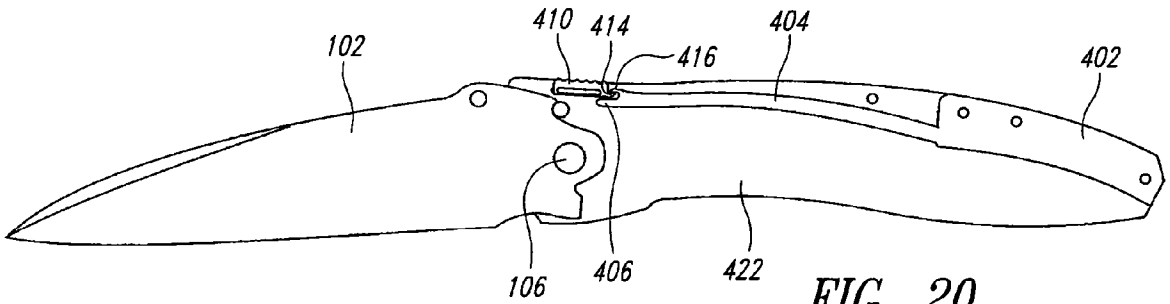

When the latch 410 is positioned away from the leaf spring 404, as shown in FIGS. 15, 17, and 18, the assist mechanism of the knife 400 is enabled, such that the leaf spring 404 applies an opening bias to the blade 102 when the blade is moved beyond the threshold point, as described above. However, when the latch 410 is moved toward the leaf spring 404 until the engagement tooth 414 is received in the notch 416 of the leaf spring 404, the assist mechanism is disabled, as shown in FIGS. 19 and 20. In this configuration, the leaf spring 404 is prevented from applying an opening bias to the blade 419. Accordingly, while the latch 410 is in the disengaged position shown in FIGS. 19 and 20, the knife 400 operates substantially as a conventional folding knife operates. The relative shapes and positions of the latch 410, the leaf spring 404, and the first surface 4089 of the tang may be selected to allow some play in the movement of the leaf spring 404 such that, whether the assist mechanism is enabled or disabled, the spring 404 can apply a bias against the first surface 408, thereby functioning to maintain the blade in the closed position.

As used in the specification and claims, the term assisted-opening refers to a mechanism or process in which a knife blade must be moved manually, e.g., by a user's thumb or finger, from the closed position toward the open position beyond a threshold, whereupon the mechanism is configured to complete the movement of the blade to the open position, without further effort by the user.

The assisted-opening mechanisms and the opening assist engagement mechanisms described above are provided as exemplary embodiments, only. Differently configured assisted-opening mechanisms will have differently configured engagement mechanisms, which also fall within the scope of the invention. For example, different assisted-opening mechanisms are disclosed in U.S. Pat. Nos. 5,815,927; 6,941,661; 6,959,494; 7,054,441; and U.S. patent application publication No. 20040244205, each of which may be adapted, in accordance with disclosed principles of the present invention, to include an engagement mechanism.

As used in the claims, the term operatively coupled is not to be construed to require a direct physical connection between elements so claimed, but only that such elements are arranged such that action of or with respect to one of the elements has a corresponding effect on the other element(s).

A bias member, as used in the claims, is an element that is configured to provide a bias, i.e., an energy potential, such as a push, a pull, a difference in pressure, etc. A bias member may be a single unitary component or a group of components configured to operate collectively to store, release, transmit, or apply the bias.

As used in the claims, the term wheel is not limited to a circular object, but refers to a rotatable element that can include, for example, a cam surface, a pawl, a knurled portion, etc.

The abstract of the present disclosure is provided as a brief outline of some of the principles of the invention, and is not intended as a complete or definitive description of any embodiment thereof, nor should it be relied upon to define terms used in the specification or claims. The abstract does not limit the scope of the claims.

Embodiments of the invention have been described with reference to folding knives. However, the scope of the invention is not limited to folding knives, but encompasses any closable knife, including knives in which a blade slides from a handle in a translation motion rather than a rotation motion.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention.

The invention claimed is:

1. A knife, comprising:

a handle;

a blade coupled to the handle so as to be movable between an open position in which the blade extends from the handle, and a closed position, in which the blade is received within the handle;

a bias member operatively coupled to the knife and configured to provide an opening-assist to the blade; and a bias member engagement mechanism switchable between an engaged condition, in which the bias member provides an opening force to move the blade toward the open position only after the blade is manually rotated from the closed position to beyond a threshold point, and a disengaged condition, in which the bias member does not provide an opening force to move the blade as the blade is moved from the closed position to the open position, the engagement mechanism including a wheel extending from a surface of the handle, a position of the wheel controlling whether the engagement mechanism is in the engaged or disengaged condition.

2. The knife of claim 1 wherein the engagement mechanism includes an engagement spring, and the wheel includes first and second selectable cam surfaces positioned such that the engagement spring bears against either the first or the second cam surface, according to the position of the wheel.

3. The knife of claim 2 wherein the second cam surface lies farther from a center of rotation of the wheel than the first cam surface, and wherein, when the engagement spring bears against the second cam surface, an end of the engagement spring is deflected away from an interference position relative to the bias member.

4. The knife of claim 1 wherein the wheel includes a pawl arranged to move into and out of an interference position relative to the bias member, according to the position of the wheel.

5. A knife, comprising:

a handle;

a blade coupled to the handle so as to be movable between an open position in which the blade extends from the handle, and a closed position, in which the blade is received within the handle;

an assisted-opening mechanism including a spring member operatively coupled to the knife and configured to apply a bias between the blade and the handle; and a switch element coupled to the knife and operatively coupled to the spring member, the switch element being switchable, by an operator, between an engaged position and a disengaged position, and enabling, while the switch element is in the engaged position, and disabling, while the switch element is in the disengaged position, operation of the assisted-opening mechanism to assist opening of the blade during movement of the blade from the closed position to the open position.

6. The knife of claim 5 wherein the switch element comprises a feature in the handle that can be pressed to either enable or disable the assisted-opening mechanism.

7. The knife of claim 5 wherein the switch element includes a wheel extending from the handle, which is rotatable between the engaged and disengaged positions.

8. A folding knife, comprising:

a handle;

a blade coupled to the handle and rotatable through an arc defined at one extreme by an open position, in which the blade extends from the handle, and at a second extreme by a closed position, in which the blade is received within the handle, a threshold position being a selected position of the blade lying on the arc between and distinct from the open and closed positions;

a bias mechanism coupled to the knife and configured to bias the blade toward the open position while the blade is in at least some portion of the arc between the threshold position and the open position, but not while the blade is in any portion of the arc between the closed position and the threshold position; and an engagement mechanism switchable between an engaged condition, in which the bias mechanism is enabled to bias the blade toward the open position, and a disengaged condition, in which the bias mechanism remains coupled to the knife but is disabled and cannot bias the blade toward the open position.

9. The folding knife of claim 8 wherein the bias mechanism is configured to bias the blade toward the closed position while the blade is between the threshold position and the closed position.

10. The folding knife of claim 8 wherein the engagement mechanism includes a switch element that is movable between an engaged position, in which the engagement mechanism is in the engaged condition, and a disengaged position, in which the engagement mechanism is in the engaged condition.

11. The folding knife of claim 10 wherein the switch element is slidable between the engaged and disengaged positions, and is accessible to an operator at an outer surface of the handle for manipulation.

12. The folding knife of claim 10 wherein the switch element is pressure actuated, and is accessible to an operator at an outer surface of the handle for manipulation, such that the operator can move the switch element from one of the engaged and disengaged positions to the other of the engaged and disengaged positions by pressing on the switch element.

13. The folding knife of claim 10 wherein the switch element is rotatable between the engaged and disengaged positions, and is accessible at an outer surface of the handle for manipulation, such that an operator can switch the engagement mechanism between the engaged and disengaged conditions by rotating the switch element.

14. The folding knife of claim 8 wherein, while the engagement mechanism is in the disengaged condition, the bias element is held in a tensioned condition, the engagement mechanism acting to prevent the bias element from releasing energy to bias the blade toward the open position.

15. The folding knife of claim 8 wherein, while the engagement mechanism is in the disengaged condition, the bias element is held in a relaxed condition, the engagement mechanism acting to prevent the bias element from storing energy to bias the blade toward the open position.

16. A folding knife, comprising:

a handle;

a blade coupled to the handle and rotatable between an open position, in which the blade extends from the handle, and a closed position, in which the blade is received within the handle;

an engagement mechanism, switchable between an enable condition and a disable condition, the engagement mechanism having a switch element that is manipulable by an operator, and that, when moved to an engaged position, switches the engagement mechanism to the enable condition, and when moved to a disengaged position, switches the engagement mechanism to the disable condition; and a bias element coupled to the knife and configured to bias the blade toward the open position only while the engagement mechanism is in the enable condition and the the blade is rotated away from the closed position toward the open position to a point beyond a selected threshold.

17. The folding knife of claim 16 wherein the switch element includes a wheel extending from a surface of the handle and rotatable between the engaged and disengaged positions.

* * * * *